US008225752B2

(12) United States Patent
Ahn

(10) Patent No.: US 8,225,752 B2
(45) Date of Patent: Jul. 24, 2012

(54) CYLINDER HEAD AND HEAD GASKET

(75) Inventor: Gil Hyun Ahn, Hwaseong (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 552 days.

(21) Appl. No.: 12/324,558

(22) Filed: Nov. 26, 2008

(65) Prior Publication Data

US 2009/0151661 A1 Jun. 18, 2009

(30) Foreign Application Priority Data

Dec. 14, 2007 (KR) ..... 10-2007-0131546

(51) Int. Cl.
*F02F 1/42* (2006.01)

(52) U.S. Cl. ..... 123/41.82 R; 123/41.01; 123/41.81; 123/193.5

(58) Field of Classification Search ..... 123/41.01, 123/41.8 R, 193.5, 41.81
See application file for complete search history.

(56) References Cited

U.S. PATENT DOCUMENTS

| | | | | |
|---|---|---|---|---|
| 4,683,844 | A * | 8/1987 | Arai et al. | 123/41.74 |
| 5,279,265 | A * | 1/1994 | Matsuo et al. | 123/41.44 |
| 5,529,027 | A * | 6/1996 | Okubo | 123/41.01 |
| 5,947,108 | A * | 9/1999 | Ban et al. | 126/247 |
| 2002/0179044 | A1 * | 12/2002 | Iizuka et al. | 123/310 |

FOREIGN PATENT DOCUMENTS

| | | | |
|---|---|---|---|
| JP | 59-99151 | U | 7/1984 |
| JP | 5-86967 | A | 4/1993 |
| JP | 2002-266696 | A | 9/2002 |
| KR | 10-0589162 | B1 | 6/2006 |
| KR | 10-0774710 | B1 | 11/2007 |

* cited by examiner

*Primary Examiner* — Noah Kamen
*Assistant Examiner* — Long T Tran
(74) *Attorney, Agent, or Firm* — Morgan, Lewis & Bockius LLP

(57) ABSTRACT

A cylinder head and a head gasket that is mounted on the cylinder head may include a reinforcing boss formed in outer edge of a valve boss portion adjacent to a coolant inlet portion of a water jacket, a bridge configured to divide the coolant inlet portion to form at least two coolant inlet holes, and/or a bolt boss portion integrally formed with edge circumference portion of the water jacket, a head bolt being mounted through the bolt boss portion, wherein the cylinder head gasket is attached to a gasket attachment surface of the cylinder head.

18 Claims, 7 Drawing Sheets

CYLINDER HEAD AND HEAD GASKET

CROSS-REFERENCE TO RELATED APPLICATION

The present application claims priority to Korean Patent Application No. 10-2007-0131546 filed Dec. 14, 2007, the entire contents of which are incorporated herein for all purposes by this reference.

BACKGROUND OF THE INVENTION

1. Field of the Invention

The present invention relates to a cylinder head and a head gasket, and more particularly to a cylinder head and a head gasket for preventing leaking of combustion gas and coolant.

2. Description of Related Art

As shown in FIG. 1, an engine for a vehicle includes a cylinder head 101 and a cylinder block 103, and a head gasket 105 is interposed between them.

The cylinder head gasket 105 sustains air-tightness between the cylinder block 103 and the cylinder head 101, and simultaneously prevents leaking of coolant and engine oil that is supplied to the engine.

As shown in FIG. 2, a gasket attachment surface is formed in a lower surface of the cylinder head 101.

The bolt boss portion 120 in which a head bolt is inserted is separated from the edge circumference portion 130 of the waterjacket WJ in the cylinder head 101 as shown in FIG. 2.

Furthermore, as shown in FIG. 3, a beading portion B having a single bead is formed in the cylinder head gasket 105 corresponding to the gasket attachment surface of the cylinder head 101 and the cylinder block 103.

Additionally, in this conventional art, an engagement force of a head bolt assembled through the bolt boss portion 120 is not sufficiently applied to the portion in which a coolant inlet portion P of the cylinder head 101 is formed due to the large space of the coolant inlet portion P, and so it is hard to correspond to the maximum pressure of the cylinder.

That is, the engagement force of the head bolt is not uniformly transferred to the vicinity of the coolant inlet portion P such that the attachment force is lowered.

Further, a crack occurs to the cylinder head gasket 105 due to deformation of the cylinder head gasket 105, and thus combustion gas, coolant, and oil can leak through the crack.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a cylinder head and a head gasket having advantages of preventing leaks of combustion gas and coolant by reinforcing a valve boss portion corresponding to a coolant inlet portion inside a water jacket and applying a gasket that has dual beading structure corresponding to a gasket attachment surface of a cylinder head.

In an aspect of the present invention including a cylinder head and a cylinder head gasket mounted on the cylinder head, the cylinder head may have a reinforcing boss formed in outer edge of a valve boss portion adjacent to a coolant inlet portion of a water jacket, a bridge configured to divide the coolant inlet portion to form at least two coolant inlet holes, and/or a bolt boss portion integrally formed with edge circumference portion of the waterjacket, a head bolt being mounted through the bolt boss portion, wherein the cylinder head gasket is attached to a gasket attachment surface of the cylinder head.

The bridge may connect edges of the coolant inlet portion in a traverse direction thereof.

The cylinder head gasket may include a beading portion corresponding to edge of the gasket attachment surface of the cylinder head to be disposed thereto, and/or a bridge sealing portion corresponding to the bridge of the cylinder head to form coolant penetration holes corresponding to the divided coolant inlet holes of the cylinder head.

A joining portion may be formed in middle of the beading portion to form double beads at both sides of the joining portion. A bead of the double beads may be connected to the coolant penetration hole.

The reinforcing boss and the bridge may be connected to each other.

In another aspect of the present invention including a cylinder head and a cylinder head gasket mounted on the cylinder head, the cylinder head may include a bridge configured to divide a coolant inlet portion to form at least two coolant inlet holes and the cylinder head gasket is attached to a gasket attachment surface of the cylinder head, and/or wherein the cylinder head gasket includes a bridge sealing portion corresponding to the bridge of the cylinder head to form coolant penetration holes corresponding to the divided coolant inlet holes of the cylinder head.

The bridge may connect edges of the coolant inlet portion in a traverse direction thereof.

The cylinder head may further include a reinforcing boss formed in outer edge of a valve boss portion adjacent to a coolant inlet portion of a water jacket.

The cylinder head may further include a bolt boss portion integrally formed with edge circumference portion of the water jacket, a head bolt being mounted through the bolt boss portion.

The cylinder head gasket may further include a beading portion corresponding to edge of the gasket attachment surface of the cylinder head to be disposed thereto. A joining portion may be formed in middle of the beading portion to form double beads at both sides of the joining portion. A bead of the double beads may be connected to the coolant penetration hole.

The reinforcing boss and the bridge may be connected to each other.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
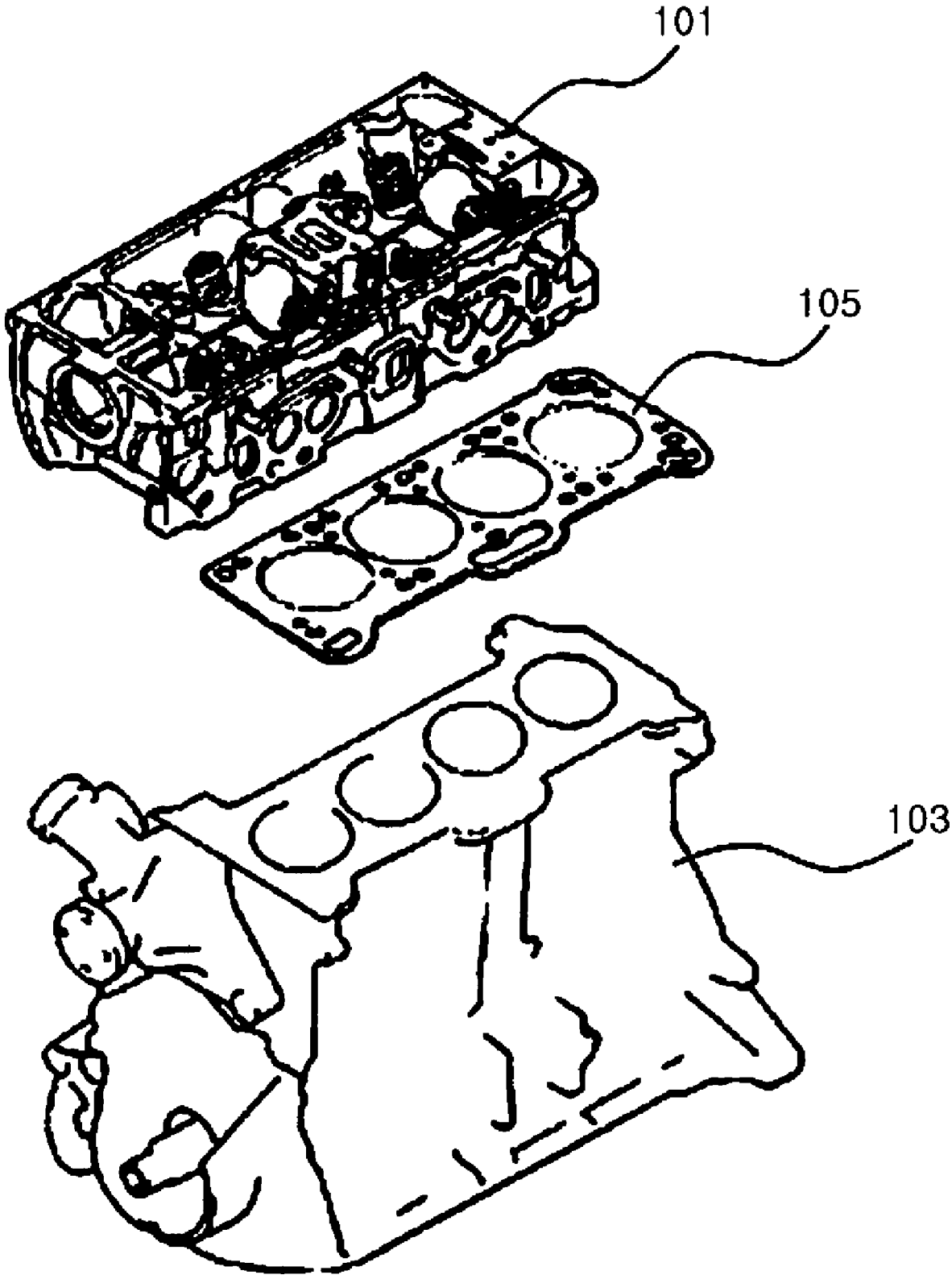
FIG. 1 is a partial exploded perspective view of a general engine body.
Figure 2:
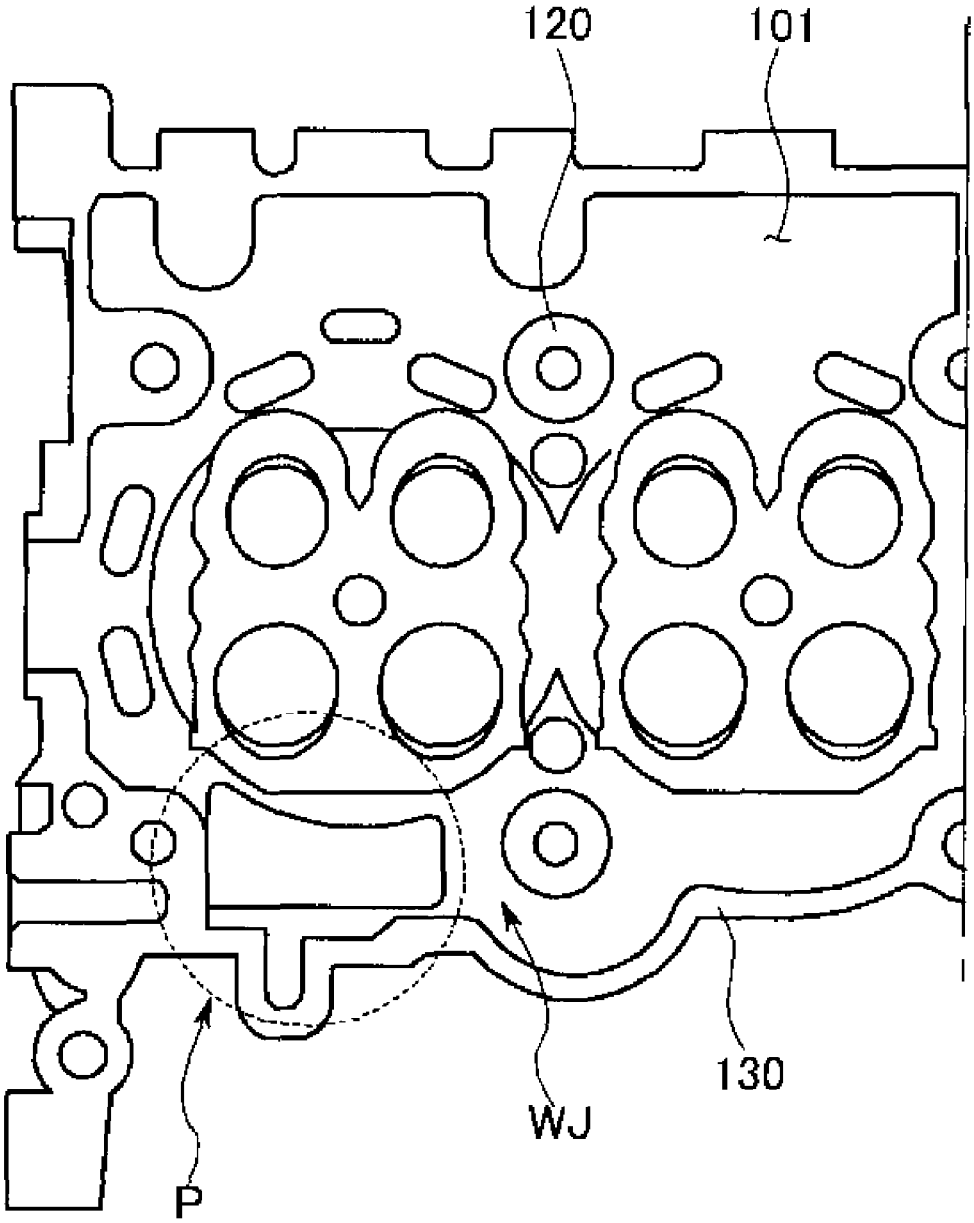
FIG. 2(Prior Art)
FIG. 2 is a partial cross-sectional view of a cylinder head including a water jacket according to FIG. 1.
Figure 3:
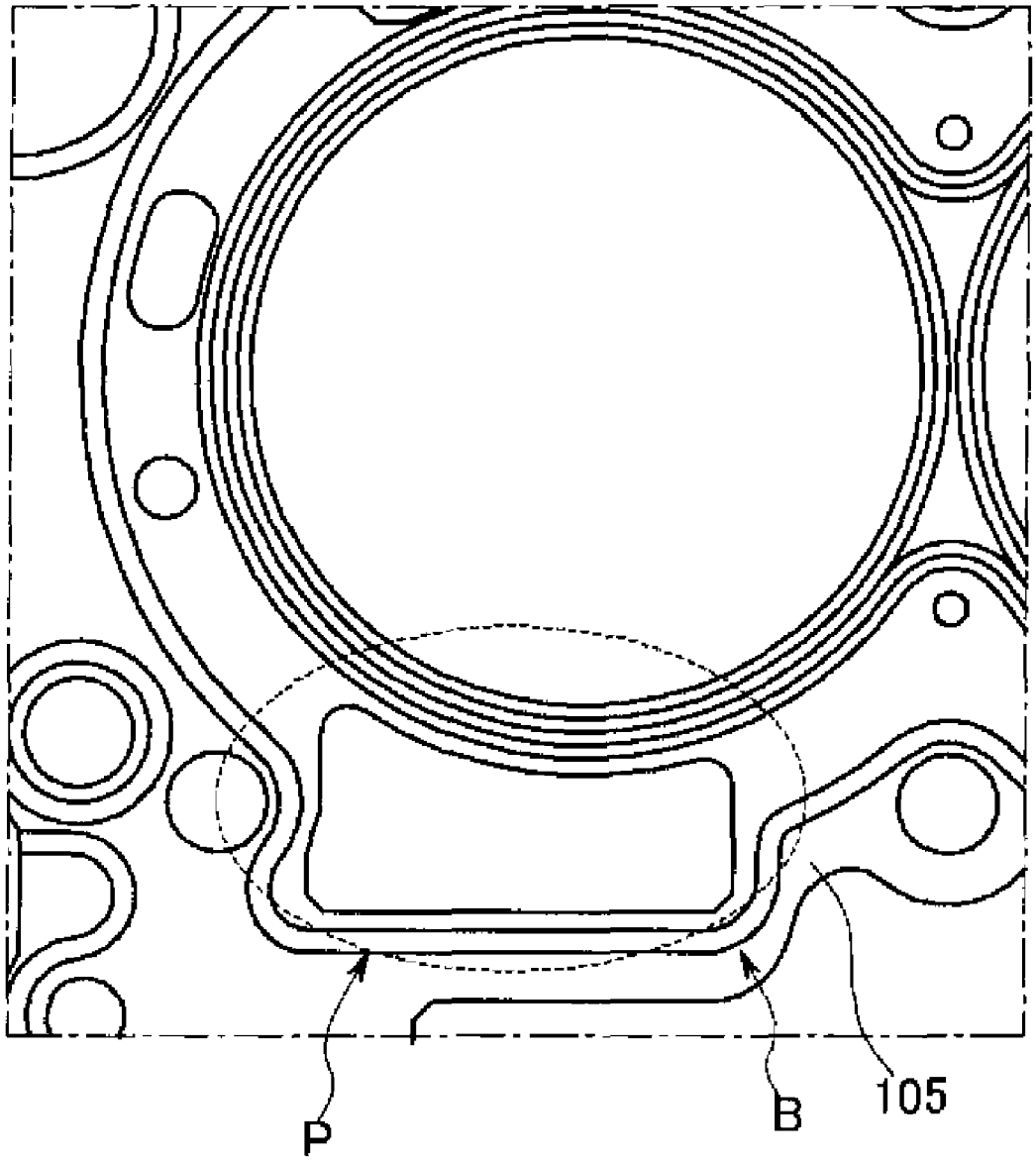
FIG. 3(Prior Art)
FIG. 3 is a partial top plan view of a cylinder head gasket according to FIG. 2.
Figure 4:
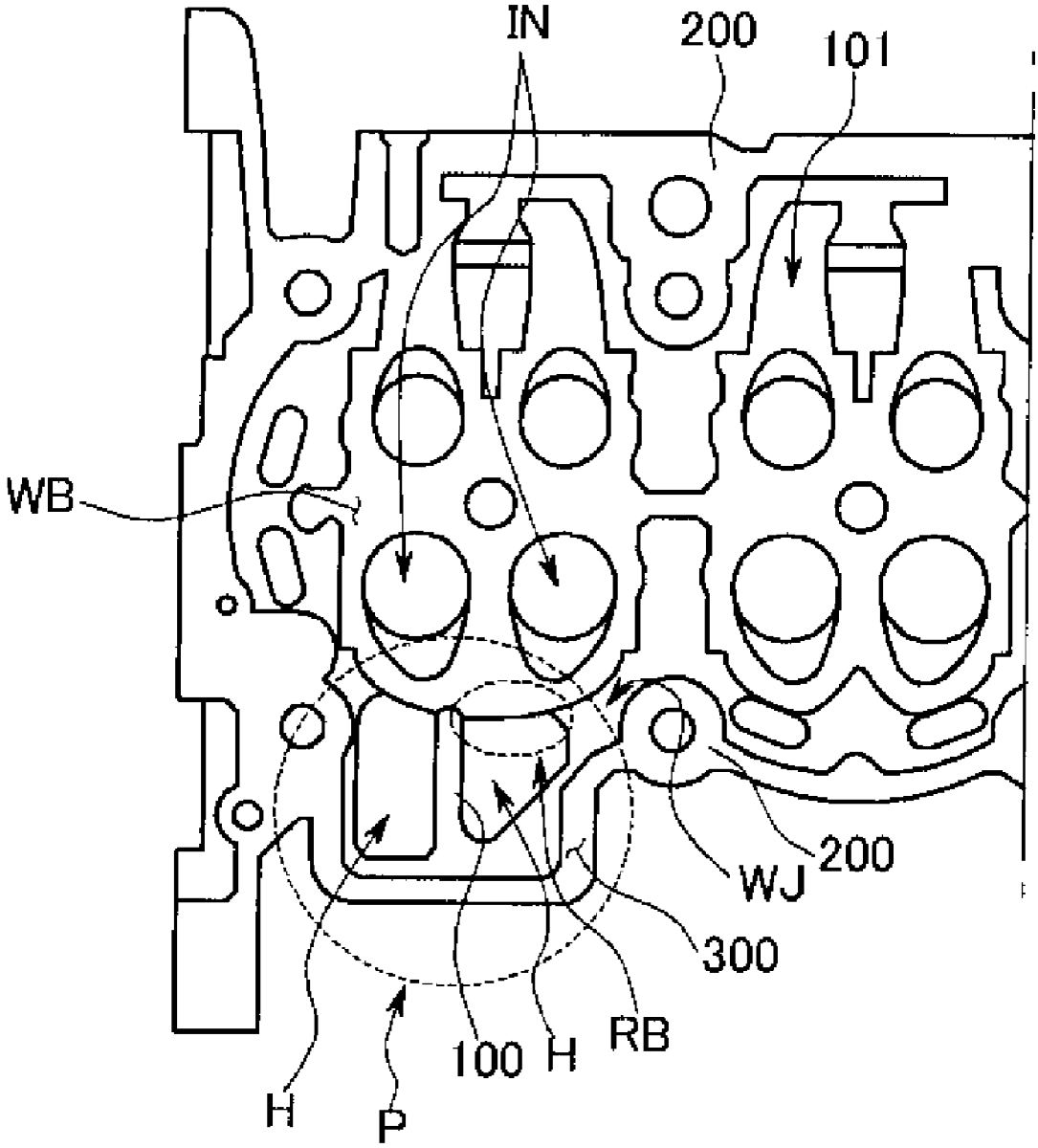
FIG. 4 is a partial cross-sectional view of an exemplary cylinder head including a water jacket according to the present invention.
Figure 5:
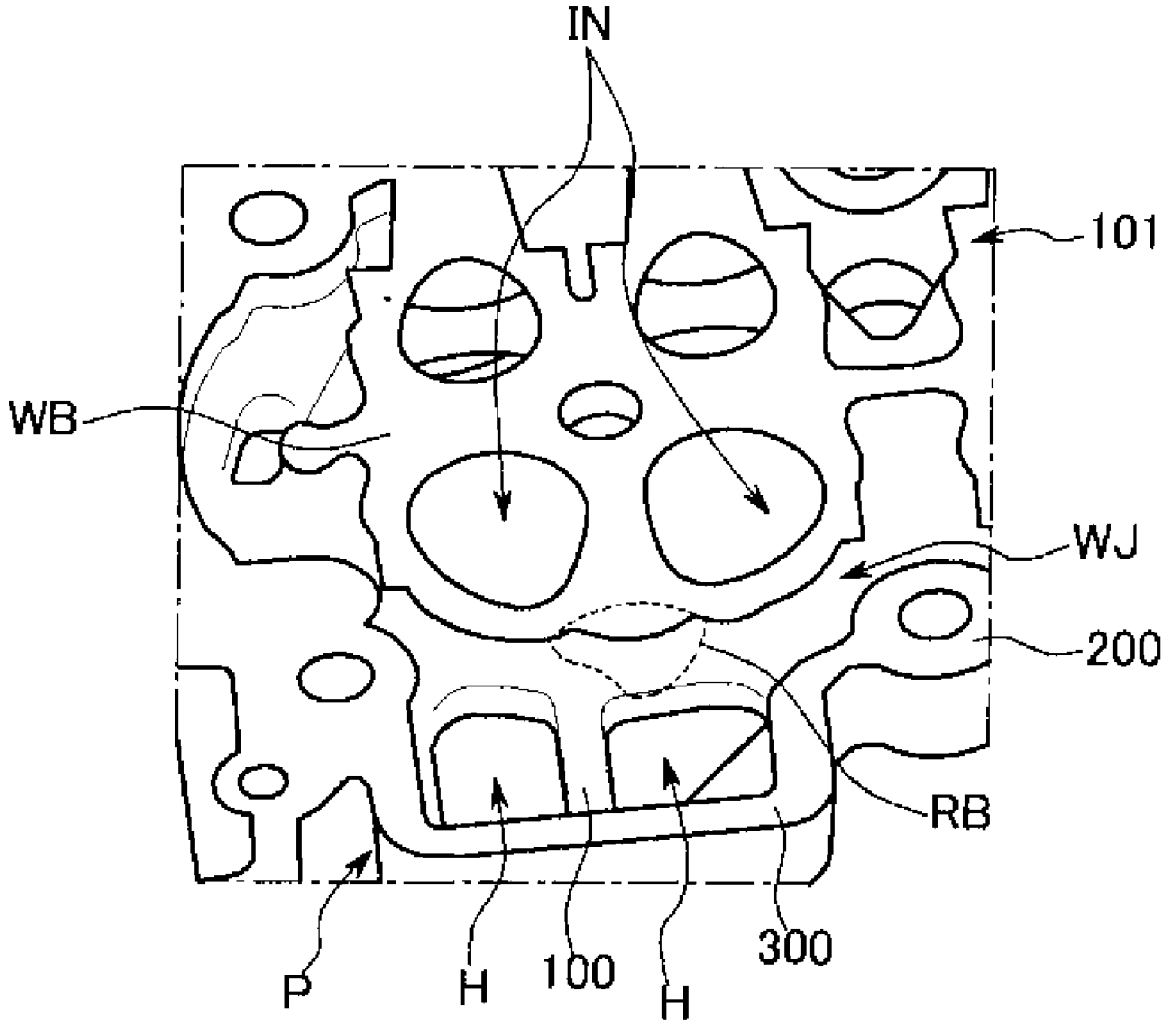
FIG. 5 is a partial detailed perspective view of an exemplary coolant inlet portion of a cylinder head according to the present invention.

FIG. 4 is a partial cross-sectional view of a cylinder head including a water jacket according to an exemplary embodiment of the present invention, and FIG. 5 is a partial detailed perspective view of a coolant inlet portion of a cylinder head according to an exemplary embodiment of the present invention.

The same reference numerals are applied to the same constituent elements throughout the drawings.

A reinforcing boss RB is formed at an edge portion of a valve boss portion WB corresponding to a coolant inlet portion P inside the water jacket WJ of a cylinder head 101 according an exemplary embodiment of the present invention.

The edge of the valve boss portion WB between two inlet holes TN is expanded to form the reinforcing boss RB that is integrally formed with the cylinder head 101. One will appreciate that the reinforcing boss may be monolithically formed with the cylinder head.

The reinforcing boss strengthens the valve boss portion WB corresponding to the coolant inlet portion P inside the water jacket of the cylinder head and a head gasket according to an exemplary embodiment of the present invention.

Accordingly, when the coolant flows through the coolant inlet portion P from a coolant pump, the lift amount of the cylinder head gasket 103 can be minimized and the leaks of combustion gas, coolant, oil, and so on can be prevented.

In another exemplary embodiment of the present invention, a bridge 100 that crosses in a traverse direction of a coolant inlet hole H in the coolant inlet portion P is integrally formed with the cylinder head 101. One will appreciate that the bridge may be monolithically formed with the cylinder head.

That is, the bridge 100 divides the coolant inlet hole H into two holes.

However, one may appreciate that the number of the bridge 100 is not limited to one but may be increased considering the performance efficiency of the engine.

In this configuration, the engagement force of the head bolt can be uniformly transferred through the bridge 100 that is formed in the coolant inlet hole H of the cylinder head and the bridge sealing portion BS that is formed in the coolant penetration hole of the cylinder head gasket 103. The bridge sealing portion BS of the cylinder head gasket 103 is a portion that corresponds to the bridge 100 of the cylinder head 101 as explained later.

In another exemplary embodiment of the present invention, the bolt boss portion 200 in which a head bolt is inserted is integrally connected to the edge circumference portion 300 of the waterjacket WJ in the cylinder head 101. That is, the bolt boss portion 200 is integrally formed with the edge of the cylinder head 101. One will appreciate that the bolt boss portion may be monolithically formed with the cylinder head.

In this configuration, the engagement force of the head bolt can be more uniformly transferred to the cylinder head gasket 103.

Figure 6:
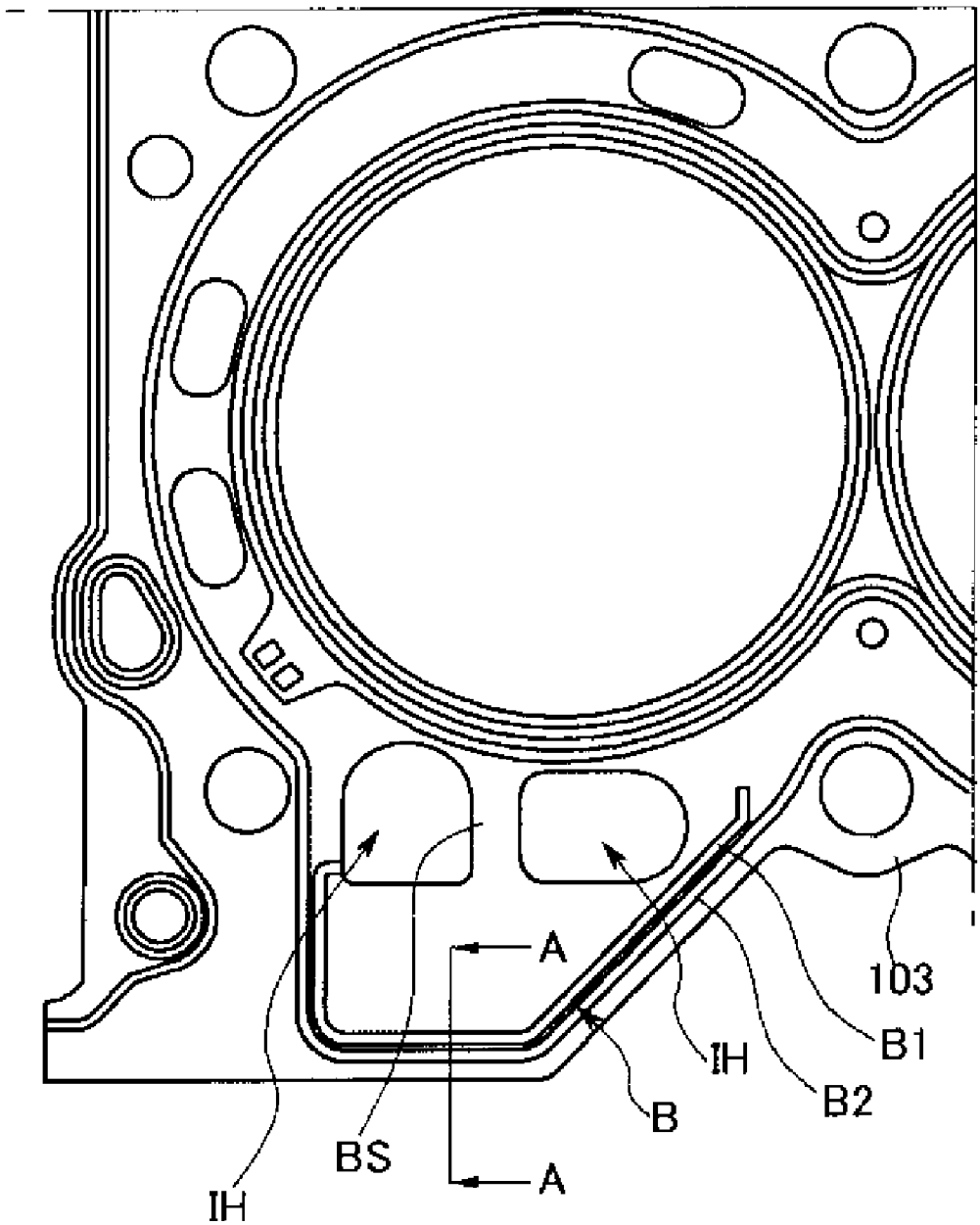
FIG. 6 is a partial top plan view of an exemplary cylinder head gasket according to the present invention.

FIG. 6 is a partial top plan view of a cylinder head gasket according to a further another exemplary embodiment of the present invention.

A beading portion B is formed corresponding to the edge of the gasket attachment surface of the cylinder head 101 in the cylinder head gasket 103.

Figure 7:
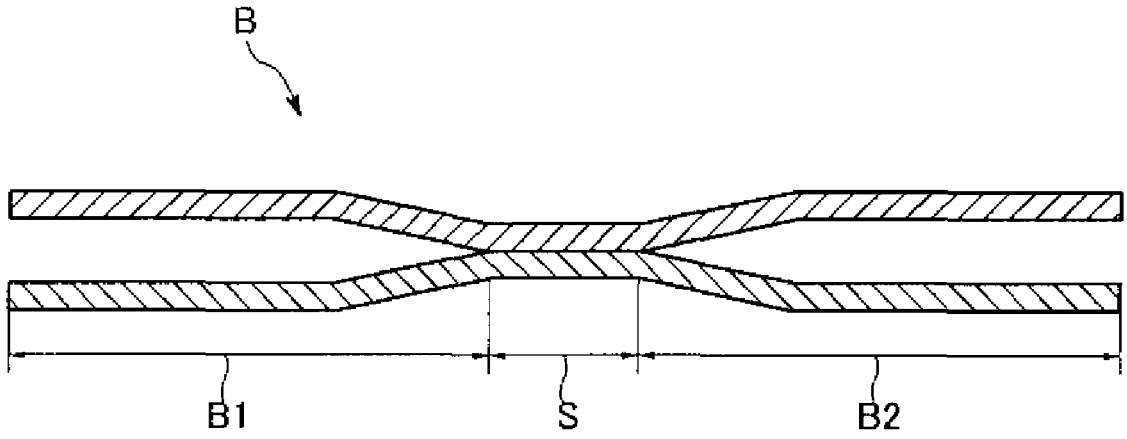
FIG. 7 is a cross-sectional view according to an A-A line of FIG. 6.

In this configuration, as shown in FIGS. 6 and 7, the beading portion B includes dual beads B1 and B2, wherein bead B1 is additionally formed along the bead B2.

The beading portion B is formed corresponding to the gasket attachment surface of the cylinder head 101, a joining portion S is formed in the middle of the beading portion B, so as to form the dual beads B1 and B2, wherein the dual beads B1 and B2 are formed to be spread out at both sides of the joining portion(S).

In an exemplary embodiment of the present invention, a portion of the bead B1 may be connected to at least a coolant penetration holes 1H of the cylinder head gasket 103 corresponding to the coolant inlet holes H of the cylinder head 101 to increase reinforcement force to the coolant penetration holes 1H as shown in FIG. 6.

Further, the bridge sealing portion (BS) is formed in the cylinder head gasket 103, the bridge sealing portion (BS) corresponding to the bridge 100 that is formed in the coolant inlet hole H of the cylinder head 101.

According to various aspects of the present invention, the valve boss portion WB is strengthened by the reinforcing boss RB in the cylinder head 101. The cylinder head gasket 103 that have the above structures may have the lift amount minimized when the coolant flows through the coolant inlet hole H from the coolant pump.

In addition, the bridge 100 and the bridge sealing portion BS that are respectively formed corresponding to the coolant inlet hole H of the cylinder head 101 and the coolant penetration hole 1H of the cylinder head gasket 103 have engagement force of the head bolt that is uniformly transferred such that the lift amount of the cylinder head gasket 103 is minimized. Accordingly, the leaks of the combustion gas, the coolant, the oil, and so on are prevented at the edge thereof.

Also, the cylinder head gasket 103 has the structure of the dual beading B1 and B2 corresponding to the gasket attachment surface of the cylinder head 101 such that the air-tightness is increased compared to a single beading structure.

Accordingly, the attachment force of the cylinder head gasket is increased and the up and down movement of the gasket corresponding to the coolant inlet portion is minimized such that the leaks of the combustion gas, coolant, oil, and so on can be prevented.

For convenience in explanation and accurate definition in the appended claims, the term "lower" is used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cylinder head and a cylinder head gasket mounted on the cylinder head, wherein the cylinder head comprises:

a valve boss portion formed in a lower surface of the cylinder head and including at least an inlet hole therein;

a reinforcing boss formed in outer edge of the valve boss portion adjacent to a coolant inlet portion of a water jacket;

a bridge that divides the coolant inlet portion and connects both ends thereof to form at least two coolant inlet holes; and a bolt boss portion integrally formed with edge circumference portion of the water jacket, a head bolt being mounted through the bolt boss portion, wherein the cylinder head gasket is attached to a gasket attachment surface of the cylinder head.

2. The cylinder head and head gasket of claim 1, wherein the bridge connects edges of the coolant inlet portion in a traverse direction thereof.

3. The cylinder head and head gasket of claim 1, wherein the cylinder head gasket comprises:

a beading portion corresponding to edge of the gasket attachment surface of the cylinder head to be disposed thereto; and a bridge sealing portion corresponding to the bridge of the cylinder head to form coolant penetration holes corresponding to the divided coolant inlet holes of the cylinder head.

4. The cylinder head and head gasket of claim 3, wherein a joining portion is formed in middle of the beading portion to form double beads at both sides of the joining portion.

5. The cylinder head and head gasket of claim 4, wherein a bead of the double beads is connected to the coolant penetration hole.

6. The cylinder head and head gasket of claim 1, wherein the reinforcing boss and the bridge are connected to each other.

7. A cylinder head and a cylinder head gasket mounted on the cylinder head, wherein the cylinder head comprises a bridge that divides a coolant inlet portion and connects both ends thereof to form at least two coolant inlet holes and the cylinder head gasket is attached to a gasket attachment surface of the cylinder head; and wherein the cylinder head gasket comprises a bridge sealing portion corresponding to the bridge of the cylinder head to form coolant penetration holes corresponding to the divided coolant inlet holes of the cylinder head.

8. The cylinder head and head gasket of claim 7, wherein the bridge connects edges of the coolant inlet portion in a traverse direction thereof.

9. The cylinder head and head gasket of claim 7, wherein the cylinder head further comprises a reinforcing boss formed in outer edge of a valve boss portion adjacent to a coolant inlet portion of a water jacket.

10. The cylinder head and head gasket of claim 7 wherein the cylinder head further comprises a bolt boss portion integrally formed with edge circumference portion of the water jacket, a head bolt being mounted through the bolt boss portion.

11. The cylinder head and head gasket of claim 7, wherein the cylinder head gasket further comprises a beading portion corresponding to edge of the gasket attachment surface of the cylinder head to be disposed thereto.

12. The cylinder head and head gasket of claim 10, wherein a joining portion is formed in middle of the beading portion to form double beads at both sides of the joining portion.

13. The cylinder head and head gasket of claim 11, wherein a bead of the double beads is connected to the coolant penetration hole.

14. The cylinder head and head gasket of claim 7, wherein the reinforcing boss and the bridge are connected to each other.

15. An engine comprising the cylinder head and head gasket of claim 1.

16. An engine comprising the cylinder head and head gasket of claim 7.

17. The cylinder head and head gasket of claim 1, wherein the bridge is connected to the reinforcing boss.

18. The cylinder head and head gasket of claim 9, wherein the bridge is connected to the reinforcing boss.

* * * * *